US005459966A

United States Patent [19]

Suarez et al.

[11] Patent Number: 5,459,966

[45] Date of Patent: Oct. 24, 1995

[54] PREFABRICATED BATHROOM WALLS

[76] Inventors: Miguel A. Suarez, 11038 Green Line Way, Orlando, Fla. 32837; Gilberto Avila, 5445 Nokomis Cir., Orlando, Fla. 32839

[21] Appl. No.: 261,934

[22] Filed: Jun. 17, 1994

[51] Int. Cl.[6] ..... A47K 3/16

[52] U.S. Cl. ..... 52/34; 52/220.1; 52/309.1; 4/670

[58] Field of Search ..... 52/34, 309.1, 506.04, 52/506.08, 786, 35, 745.02, 745.1, 745.16, 220.1, 220.3; 4/663, 664, 612, 614, 690

[56] References Cited

U.S. PATENT DOCUMENTS

| | | | |
|---|---|---|---|
| 3,221,454 | 12/1965 | Togni | 4/670 X |
| 3,766,574 | 10/1973 | Smid, Jr. | 52/34 X |
| 3,827,818 | 7/1974 | Alosi | 52/347 C |
| 3,855,296 | 5/1975 | Stout | 52/220.3 X |
| 4,627,203 | 12/1986 | Presswalla et al. | 52/220.3 X |
| 4,655,011 | 9/1987 | Borges | 4/670 |
| 4,745,712 | 5/1988 | O'Leary | 52/34 |
| 4,788,802 | 12/1988 | Wokas | 52/34 X |
| 5,406,757 | 4/1995 | Fleishman | 135/15.1 X |

*Primary Examiner*—Carl D. Friedman
*Assistant Examiner*—Creighton Smith
*Attorney, Agent, or Firm*—William M. Hobby, III

[57] ABSTRACT

A prefabricated polymer bathroom wall apparatus has a unitary molded wall section formed of a waterproof polymer and having a gridwork of interconnected molded frame portions forming a plurality of hollow cells therebetween and having a plurality of edges with one or more insets in the edges. Some of the molded frame portions are formed with elongated passageways therein to form prefabricated pipes in the wall section opening at the wall insets. Coupling members are attached to the ends of the passageways within the wall section edge insets whereby a lightweight prefabricated wall section can be attached to a wall for coupling to a building's plumbing and to plumbing fixtures. A method of making a prefabricated wall section includes forming a mold having a gridwork pattern with solid frame members forming hollow cells, placing mold inserts in the formed mold shaped to form passageways of predetermined size and positioning within the frame members, pouring a portion of the prefabricated wall section prior to removing the mold inserts and enclosing the passageways by completing the molding.

18 Claims, 3 Drawing Sheets

PREFABRICATED BATHROOM WALLS

BACKGROUND OF THE INVENTION

The present invention relates to a prefabricated polymer bathroom wall made of PVC or the like and to a method of making a prefabricated wall section which is lightweight with the frame members having pipes and conduits formed as part thereof.

In the past, it has been common to provide wall plumbing in bathrooms in order to install laboratories, showers, tubs, water closets and the like in the bathrooms. This requires predetermined plumbing, including water pipes and sewer pipes interconnected to the exact position for mounting the different plumbing fixtures. Since the plumbing fixtures are commonly mounted in a similar fashion to a wall which requires similar plumbing for a wide variety of buildings, it has been suggested in the past to make wall sections out of prefabricated factory built units which are attached within the bathroom for thereafter hanging the plumbing fixtures and connecting to the plumbing.

Typical prior art patents which show prefabricated bathroom and utility building assemblies can be seen in the Togni U.S. Pat. No. 3,221,454 for a Prefabricated Utility Building Assembly which prefabricates the pipes into a hollow wall section which can be mounted in a bathroom or other utility room. The Sanders et al. U.S. Pat. No. 2,653,357 shows a prefabricated plumbing installation having the pipes preinstalled within a wall section for framing including the sewer pipes and water pipes, which wall sections are ready for installation and connection to the building plumbing. Similarly, the Smid, Jr. U.S. Pat. No. 3,766,574, is for a Prefabricated Plumbing Partition adapted for installation in a wall of a building which has the plumbing assembly encapsulated in a cellular polyurethane block and has the water supply and drain pipes formed within the molded partition and extending therefrom for connection to the building's plumbing and to the plumbing fixtures. The Dykstra U.S. Pat. No. 3,765,036 is a Modular Laboratory Cabinet which has part of the plumbing for a laboratory built into a cabinet for connection to the building's plumbing. The Armstrong U.S. Pat. No. 3,611,451, is a Plumbing Module with predetermined pipe portions formed for attaching in a building wall for connecting plumbing fixtures thereto. This prefabricated molded plumbing module is an integral molded unit adapted to be installed between the studs of the building and has interconnected piping for connection with the waste and drain fittings of a water closet bowl and with the laboratory and bathtub or shower. The Alosi U.S. Pat. No. 3,821,818, is a Prefabricated Bathroom Wall made of poured concrete and having the pipes set within the concrete with extending portions for attaching to the building plumbing and for attaching plumbing fixtures thereto. Inasmuch as this unit is a poured concrete unit, it is more suitable for multistory buildings which frequently require poured concrete or similar type walls and would therefore be unsuitable for many residential buildings because of its weight of the concrete and the problems of attaching it into an existing wood building.

In contrast to these prior art patents, the present invention is directed towards a molded unit which is lightweight and made out of the same types of polymer that plastic hot water and cold water pipes are made of and that sewer lines are frequently made of so that the lines can be incorporated into the framework. Because of the gridwork and open cellular structure, it produces a lightweight but strong wall section which is readily connectable to the building's plumbing and readily attachable to a wall and whose strength is greatly increased by the attaching of wall panels or plywood to either side of the cellular structure to make the structure have the same general strength characteristics as might be obtained in honeycomb panels and the like.

SUMMARY OF THE INVENTION

A prefabricated polymer bathroom wall apparatus has a unitary molded wall section formed of a waterproof polymer and having a grid framework of interconnected molded frame portions forming a plurality of hollow cells therebetween and having a plurality of edges with one or more insets in the edges. Some of the molded frame portions are formed with elongated passageways therein to form prefabricated pipes in the wall section opening at the wall insets. Coupling members are attached to the ends of the passageways within the wall section edge insets whereby a lightweight prefabricated wall section can be attached to a wall for coupling to a building's plumbing and to plumbing fixtures. A method of making a prefabricated wall section includes forming a mold having a grid framework pattern with solid frame members forming hollow cells, placing mold inserts in the formed mold shaped to form passageways of predetermined size and positioning within the frame members, pouring a portion of the prefabricated wall section prior to removing the mold inserts and enclosing the passageways by completing the molding.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
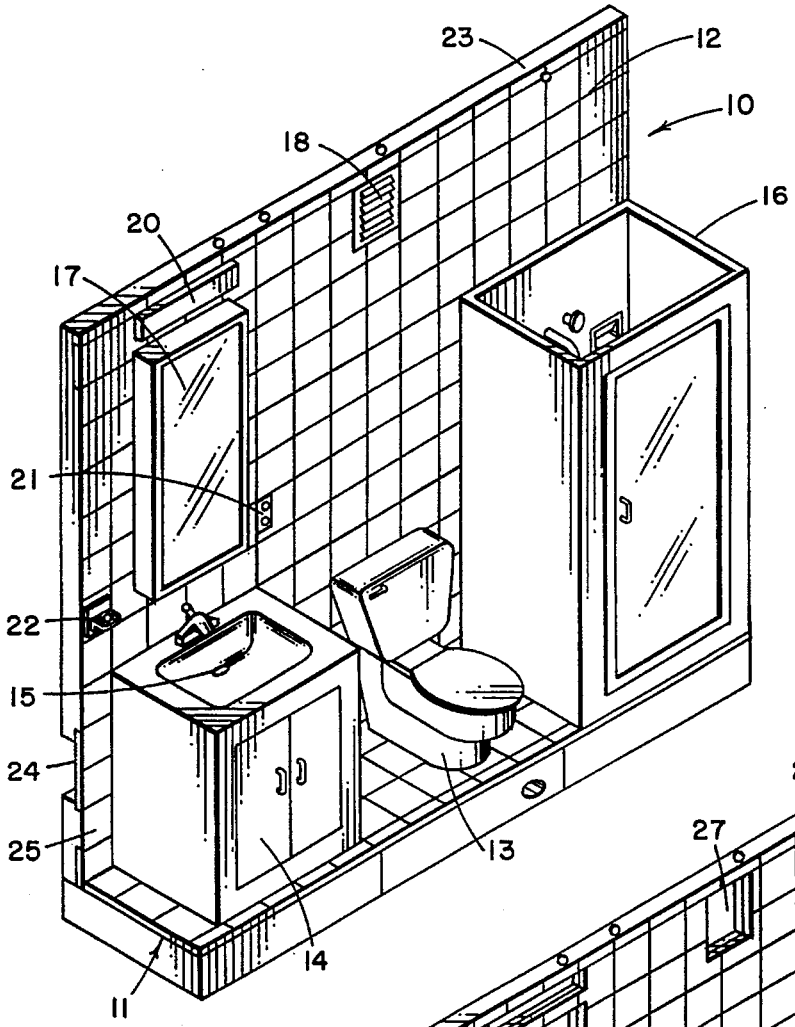
FIG. 1 is a perspective view of an installed prefabricated bathroom wall in accordance with the present invention.
Figure 2:
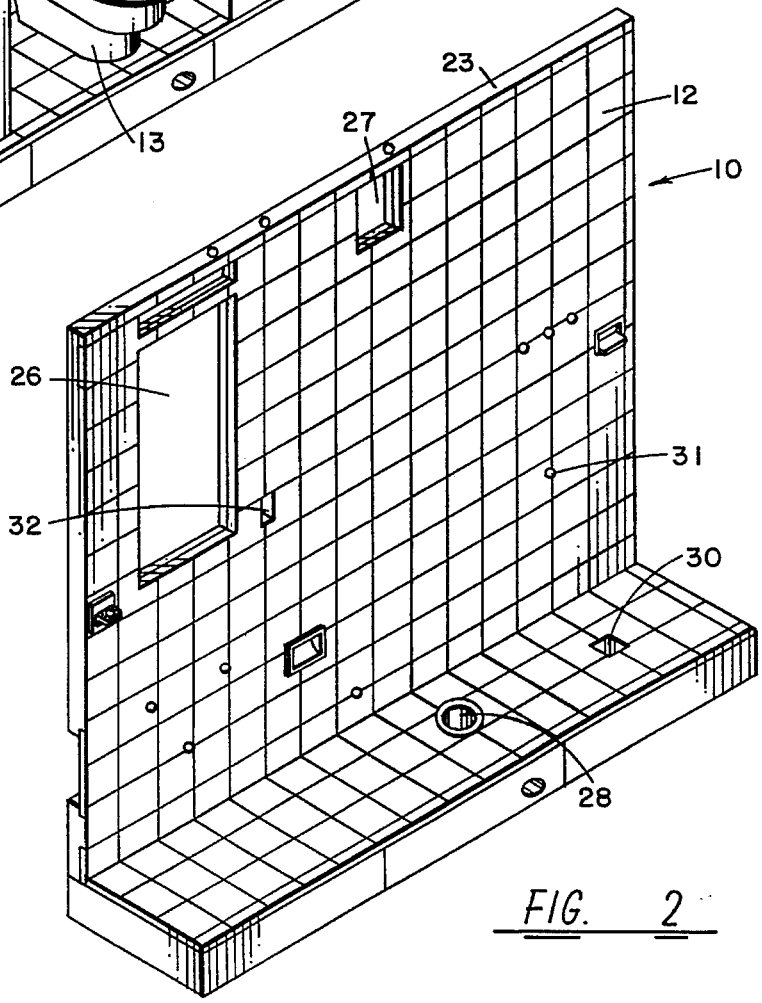
FIG. 2 is a perspective view of the wall section of FIG. 1 having the plumbing fixtures removed therefrom.
Figure 3:
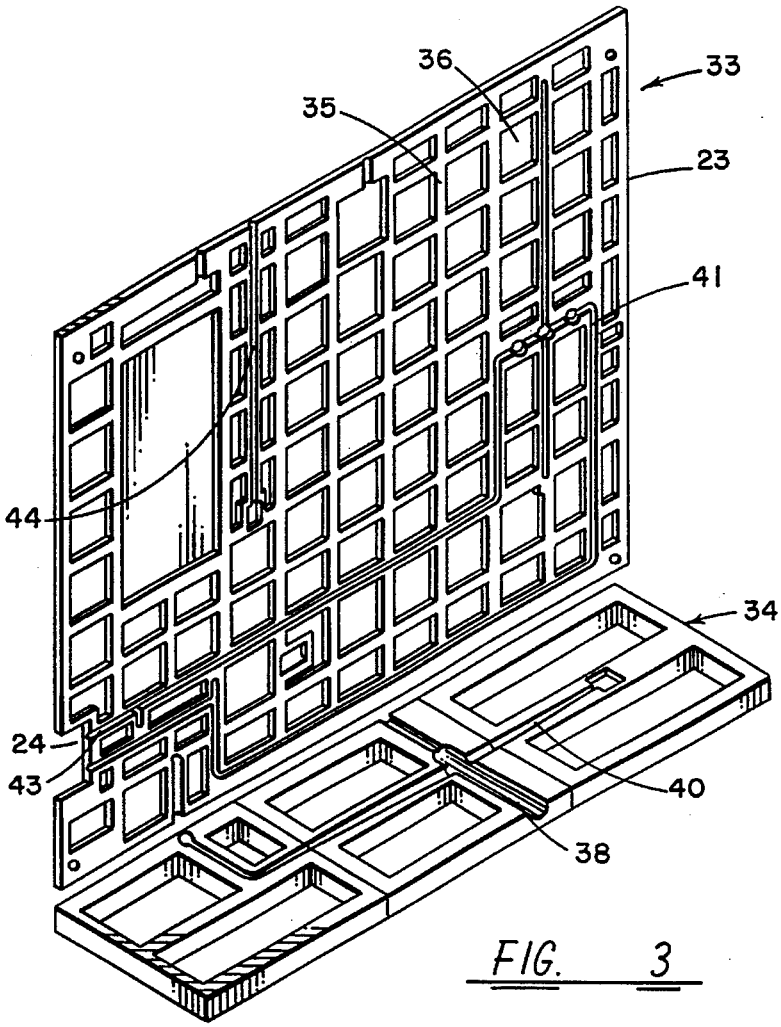
FIG. 3 is a perspective view of the wall panels of FIGS. 1 and 2 without the wall covering.

Referring to the drawings and especially to FIGS. 1–3, a prefabricated cellular bathroom wall unit 10 is illustrated having a prefabricated bathroom floor portion 11 having a wall covering 12 molded onto one side. The walls have installed on the floor 11, a water closet 13, a laboratory cabinet 14 having a laboratory 15 mounted therein, a shower stall 16, and a mirror and vanity 17. Also installed is an air vent 18, a light 20, and an electrical receptacle 21 along with a wall attached soap dish 22. In FIG. 1, the edge frame members 23 can be seen along the edges of the wall section as can an inset 24 having an inset cover 25.

As further seen in FIG. 2 with the plumbing fixtures removed, an opening 26 allows the mounting of the mirror and vanity therein while an opening 27 allows the vent cover 18 to allow the passage of air for ventilating the bathroom. The panels, as shown here, have a sewer line connection 28 for attaching the water closet thereover along with a drain connection 30 for the shower stall and a plurality of water connection lines 31. The wall section also has a receptacle box 32 for installing an electrical receptacle.

As further seen in FIG. 3, the prefabricated cellular wall section portion 33 has the wall covering removed and is connected adjacent the floor prefabricated section 34 and has the edge frame members 23 along with a gridwork of frame members 35 which are molded as one modular unit having a plurality of open cells 36 spread throughout the molded unit to reduce the weight of the overall unit as well as to reduce the amount of polymer materials used in the molding operation and to increase the strength of the frame unit when a panel is attached thereover or molded to one side. The molded unit 33 has a plurality of openings 37 for bolting the unit to a conventional wood or steel framed wall. In the view in FIG. 3, portions of the panels 33 and 34 have been removed to thereby show the preformed pipe line including the drain lines 38 and 40 as well as the shower water pipes 41 and the main water line 42 connected with an opening 43 in the molded inset 24 in the side of the panel frame 33. Also molded into the polymer frame members is a passageway 44 which replaces the thin wall conduit used for electrical wiring to run the wires to the receptacle opening since the molded polymer material used to make the cellular framework 33 and 34 is of the same polymer used to make water pipes and drain pipes, such as PVC and extended PVC (polyvinyl chloride), the pipes are formed into the frame members 35 without having to have pipes molded in. This saves on both weight and cost of preparing the prefabricated units 33 and 34. The prefabricated water and sewer lines are shown in FIG. 3 but it will be understood that they would normally be molded into the frame and you would not see the water or drain lines. Also, FIG. 3 has the framework molded without the wall covering but the wall covering of FIGS. 1 and 2 have been molded as part of the wall in one molding operation.

Figure 4:
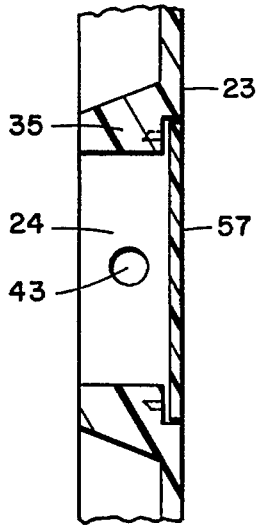
FIG. 4 is a sectional view taken on line 4—4 of FIG. 5.
Figure 5:
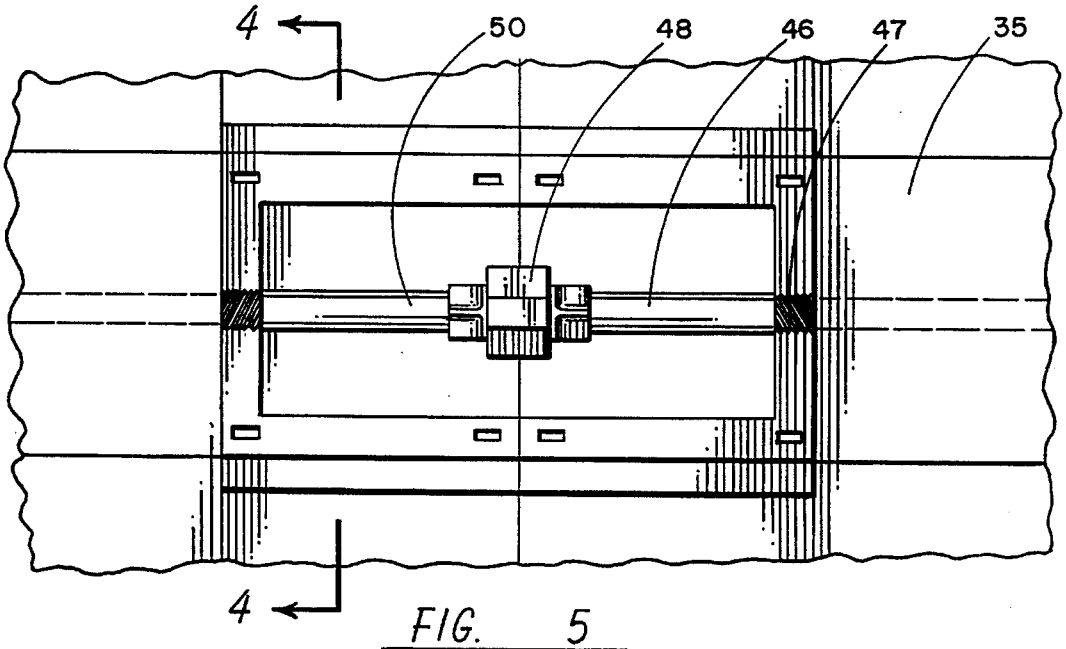
FIG. 5 is a sectional view taken through the inset in the wall panels of FIGS. 1–3 with the plumbing couplings attached.

As seen in FIGS. 4 and 5, the edge framework 23 has grid frame members 35 adjacent the inset 24 to more clearly show one of the pipe openings 43 into the inset 24. The pipe openings are formed such that a coupling having a threaded or nipple end, such as the coupling 46 in FIG. 5, can be threaded with the threads 47 directly into the opening 43 for a connection and may have a pressure fitted connection 48 for connecting to a separate modular wall unit coupling 50. A panel 51 connects over the inset portion 24 to cover up the coupling yet give excess to the edge couplings as needed.

Figure 7:
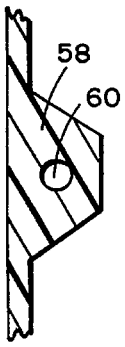
FIG. 7 is a sectional view taken through one pipe frame member.
Figure 8:
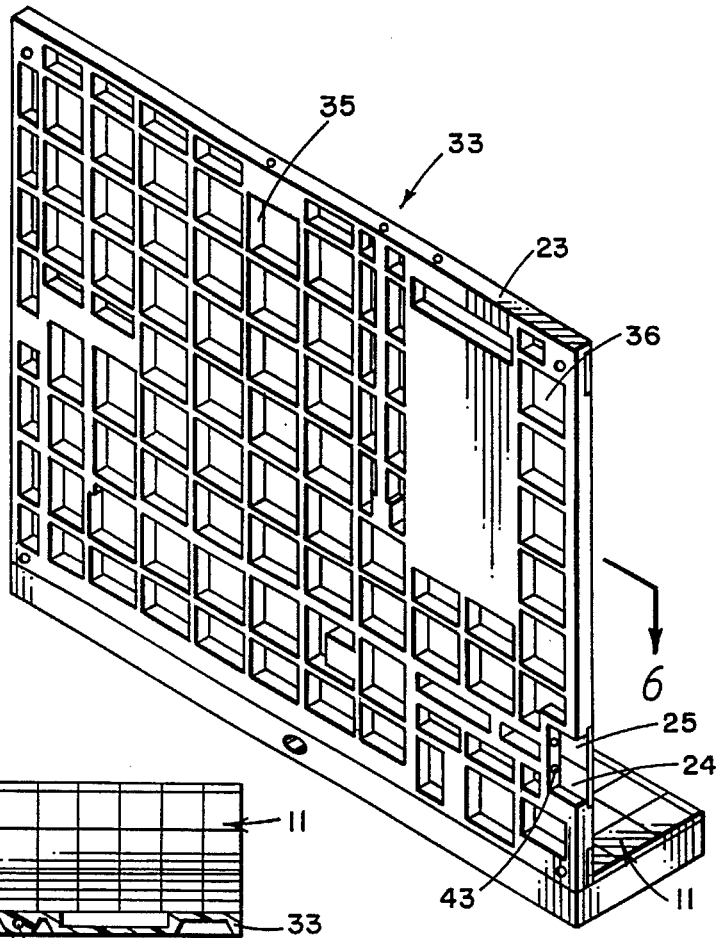
FIG. 8 is a rear perspective view of the wall of FIGS. 1–3.
Figure 6:
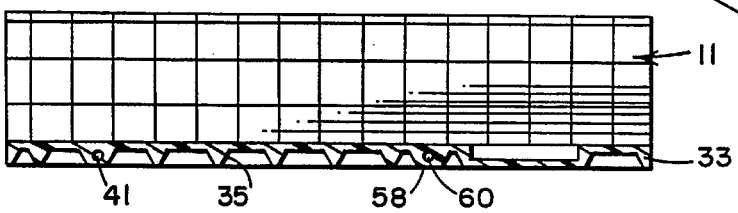
FIG. 6 is a sectional view taken through lines 6—6 of FIG. 8.

In FIG. 7, one of the water pipe frame members 58 can be seen having a water pipe 60 formed therein without having to place a pipe within the molded material. FIG. 8 shows the back of the molded unit of FIG. 3 having the prefabricated panel 33 connected to the prefabricated panel 34 forming a portion of the bathroom floor. FIG. 6 shows a sectional view of the prefabricated polymer frame 33 having the formed water pipe 60 in one of the larger frame members 58 which distinguishes from the smaller polymer frame members 35.

Figure 9:
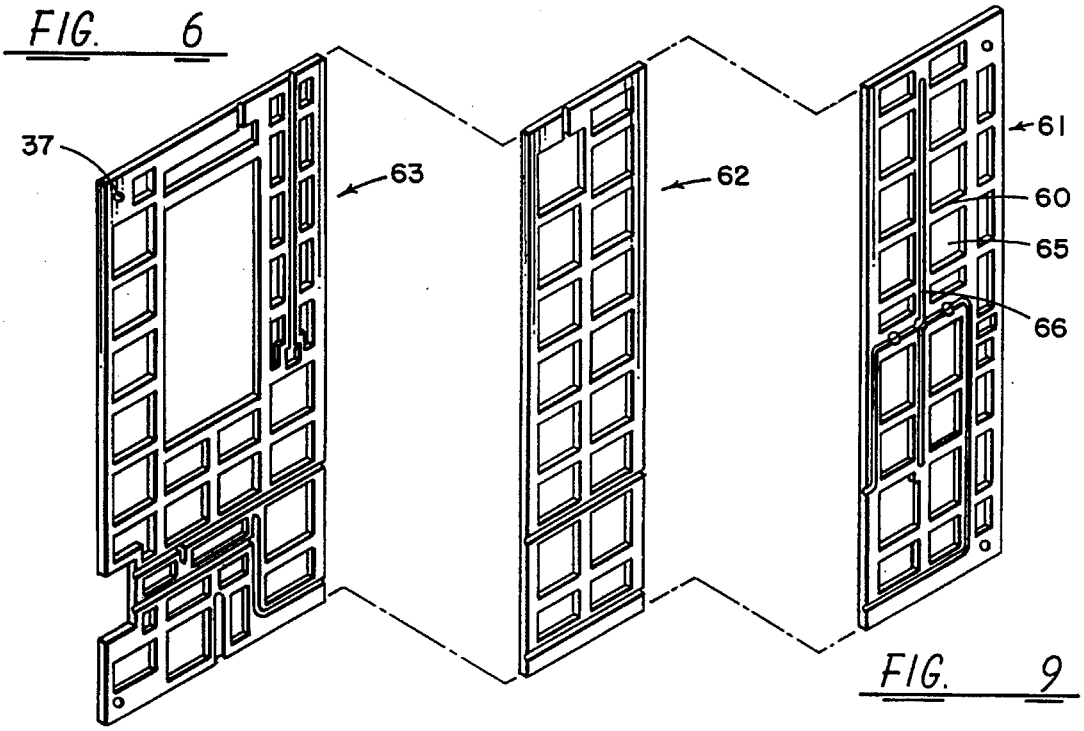
FIG. 9 is a perspective view of three interconnecting modular wall units.

FIG. 9 illustrates a second embodiment in which a plurality of prefabricated modular cellular panels 61, 62, and 63 are formed so that they interconnect to form a complete bathroom wall plumbing system with all the pipes formed therein and which can be interconnected at the pipe sections and then have wall coverings placed thereover. The modular panels each have a gridwork of polymer frame units 64 forming a series of open cells 65 with some of the frame members having molded end pipes 66 therein. Thus, the unit as shown in FIG. 9, would be similar to the unit shown in FIGS. 1–8 except that unit is formed in three separate units which are assembled and attached directly to a wall and to each other.

The process of making the panels as shown in FIGS. 1–9 includes forming a cellular pattern to make a mold and making a mold to which mold inserts can be positioned into the frame portions and then the mold can be partially filled with a thermal plastic polymer and then the mold inserts removed and the remainder of the mold filled to form the pipes within the framework. Alternatively, very thin mold inserts can be left within the mold for maintaining the pipes within the mold section. In this embodiment, pipes are formed from the passageways formed within the molded framework while the inserts are merely thin lining to keep the polymer from filling the passageways and blocking the water and sewer lines. At this point, a Prefabricated modular wall unit is made of a polymer material, such as a molded PVC, which has molded into a cellular gridwork, sewer and water lines which is made in a wall unit as well as a floor unit adjacent the wall and which is formed in a lightweight grid cellular framework which has great strength because of the cellular framework so that when panels are attached, such as by gluing the panels to the front and back of the modular unit illustrated, a reinforced cellular panel is created. The unit also may have predetermined drilled or formed holes for attaching the modular plumbing unit to an existing wall and to avoid cutting into the molded water lines. However, it should be clear that the present invention is not to be construed as limited to the forms shown which are to be considered illustrative rather than restrictive.

I claim:

1. A prefabricated polymer bathroom wall comprising:

a unitary molded cellular wall section formed of a water proof polymer and having a gridwork of interconnected molded frame portions forming a plurality of hollow cells therebetween and having a plurality of edges, said wall section edges having a plurality of insets therein;

predetermined molded frame portions being formed with elongated passageways therein to form prefabricated pipes in said wall section, said passageways intersecting said wall section edge portions at said wall section edge inset areas; and coupling members attached to said molded frame portion passageways at the intersection with said wall section edge portion edge inset areas, whereby a prefabricated wall section can be attached to a bathroom wall and connected with coupling members to a building's plumbing.

2. A prefabricated bathroom wall in accordance with claim 1 in which said polymer is a polyvinyl chloride polymer.

3. A prefabricated bathroom wall in accordance with claim 2 in which said cellular wall section has holes formed in each corner for attaching said wall panel to said wall framing.

4. A prefabricated bathroom wall in accordance with claim 3 including a coupling formed therein for a sink.

5. A prefabricated bathroom wall in accordance with claim 4 including a coupling formed therein for a toilet.

6. A prefabricated bathroom wall in accordance with claim 5 in which one of said frame portions has a passageway formed therein for electrical wiring.

7. A prefabricated bathroom wall in accordance with claim 6 including a cellular base frame unit for a bathroom floor and having a line coupling therein.

8. A prefabricated bathroom wall in accordance with claim 7 in which said molded cellular wall section has at least one inset therein along one edge thereof and having a covering thereon.

9. A prefabricated bathroom wall in accordance with claim 8 in which said gridwork of interconnected molded frame portions and has thicker portions therein having said passageways therein.

10. A prefabricated bathroom wall in accordance with claim 9 including a wall covering attached over one side of said grid work of interconnected molded frame portions.

11. A prefabricated bathroom wall in accordance with claim 1 in which said unitary molded cellular wall section includes a decorative wall covering formed on one side of said gridwork of interconnected molded frame portions.

12. A method of making a prefabricated wall section comprising the steps of:

forming a mold for a prefabricated cellular wall section with a gridwork pattern having solid frame members forming hollow cells;

placing mold inserts in said formed mold shaped to form passageways of predetermined size and in predetermined frame members;

molding a portion of a prefabricated wall section within said mold and over mold passageway inserts;

removing said mold inserts; and enclosing said passageways formed by said mold inserts in said gridwork pattern, whereby a prefabricated molded wall section has passageways formed therein.

13. A method of making a prefabricated wall section in accordance with claim 12 including the step of attaching pipe couplings to said passageway openings along the edge of said molded prefabricated cellular wall section.

14. A method of making a prefabricated wall section in accordance with claim 13 including the step of forming holes through said wall section for attaching said prefabricated wall section to a building.

15. A method of making a prefabricated wall section in accordance with claim 14 including the step of forming insets into said prefabricated wall section edges.

16. A method of making a prefabricated wall section in accordance with claim 15 including the step of forming water and drain lines in said prefabricated wall section.

17. A method of making a prefabricated wall section in accordance with claim 16 including the step of forming electrical conduit lines in said prefabricated wall section.

18. A method of making a prefabricated wall section in accordance with claim 17 including the step of attaching a panel to said prefabricated cellular wall section.

* * * * *